United States Patent [19]

Kaesser et al.

[11] 4,012,166

[45] Mar. 15, 1977

[54] SUPERSONIC SHOCK WAVE COMPRESSOR DIFFUSER WITH CIRCULAR ARC CHANNELS

[75] Inventors: Merle L. Kaesser, Waterloo, Iowa; Homer J. Wood, Sherman Oaks, Calif.

[73] Assignee: Deere & Company, Moline, Ill.

[22] Filed: Dec. 4, 1974

[21] Appl. No.: 529,498

[52] U.S. Cl. ..... 415/181; 415/207; 415/211

[51] Int. Cl.[2] ..... F04D 21/00; F04D 29/44

[58] Field of Search ..... 415/204, 206, 207, 211, 415/181, 219 C

[56] References Cited

UNITED STATES PATENTS

| | | | |
|---|---|---|---|
| 2,596,646 | 5/1952 | Bucki | 415/211 |
| 2,708,883 | 5/1955 | Keller et al. | 415/211 |
| 2,819,837 | 1/1958 | Loeb | 415/211 |
| 3,150,823 | 9/1964 | Adams | 415/211 |
| 3,765,792 | 10/1973 | Exley | 415/181 |
| 3,778,186 | 12/1973 | Bandukwalla | 415/211 |
| 3,905,721 | 9/1975 | Fitzpatrick | 415/207 |

OTHER PUBLICATIONS

Publication: Centrifugal Pumps & Blowers by Austin H. Church Copyright 1944 pp. 19, 20, 118–128. 415–206.

*Primary Examiner*—Henry F. Raduazo
*Attorney, Agent, or Firm*—Fraser and Bogucki

[57] ABSTRACT

A supersonic shock wave compressor diffuser forms a concentric annulus about a radial compressor having a central axis. Circular channels diverge with an increasing divergence angle as they extend along an arcuate longitudinal center line from an inner circumference very near the periphery of the compressor to the outer circumference of the diffuser. Shock waves may occur within the channels near the inner circumference of the diffuser or may occur within a vaneless diffusion space adjacent the periphery of the compressor and provide efficient energy conversion and reduce the velocity substantially below MACH 1 to further improve the efficiency of the subsonic diffusion downstream therefrom. A logarithmic spiral is approximated by a circular arc subtended by the channel longitudinal axes to permit recovery of angular momentum while the circular cross section of the channels permits recovery of swirl velocity energy. The required diameter of the outer circumference of the diffuser is reduced by using the shock waves to greatly reduce gas velocity within a short distance, by the curvature of the channels and by the angle of incidence of the longitudinal channel axes.

21 Claims, 3 Drawing Figures

SUPERSONIC SHOCK WAVE COMPRESSOR DIFFUSER WITH CIRCULAR ARC CHANNELS

BACKGROUND OF THE INVENTION

1. Field of the Invention

This invention relates to channel diffusers for supersonic centrifugal compressors and more particularly to curved channel diffusers which produce shock waves near the inner circumference thereof and which have channels that diverge at an increasing rate with increasing distance therealong from the inner circumference.

2. Description of the Prior Art

Single shaft gas turbine engines employ an impeller wheel coupled to rotate with a turbine wheel at a high rate of speed. Working gases enter the impeller wheel from a low pressure source such as the atmosphere and are expelled radially outward from the impeller with a high velocity which may have both tangential and radial components. A diffuser disposed about the periphery of the impeller receives the high velocity gases and converts the kinetic energy of the gases to static pressure. Economy and efficiency often require that pressure range of 6:1 to 10:1 be provided by a single stage compressor.

The efficiency of a gas turbine engine is strongly dependent upon the temperature and pressure of gases leaving the diffuser. Thus, even small changes in diffuser efficiencies which result in converting more of the kinetic energy to static pressure and less to heat can have important effects on engine performance. This is particularly true in engines having heat recuperators where the temperature decrease can be partly compensated for by an increase in useful heat transfer from the exhaust.

However, working fluid leaves the impeller wheel with very high velocities and complex flow patterns which make the design of optimal diffusers extremely difficult. If the flow path cross-sectional area increases too rapidly gas separates from the channel walls of a diffuser and extremely inefficient reverse flow develops along the walls. On the other hand, if the cross-sectional area increases too slowly the frictional losses along the channel walls are excessive. Further losses result from the inability of diffuser channels to anticipate the natural swirl of gases leaving the impeller wheel. Even more complexity is added by a transition from supersonic to subsonic velocities. The design of channel diffusers is thus a very complex and demanding art.

One channel diffuser arrangement is described in U.S. Pat. No. 3,333,762, "Diffuser For Centrifugal Compressor" to Vrana. Vrana describes a channel diffuser wherein each channel has a straight line longitudinal central axis near the inlet thereto which extends tangentially from the inner circumference. The channels are cylindrical near the inner circumference where adjacent channels intersect with one another and become conical about midway along the longitudinal axis to mate with a conical trumpet-like element near the outer circumference. Adjacent the inner circumference, intersecting adjacent channels are spaced so as to avoid the occurrence of a normal shock within the channels.

Another known channel diffuser arrangement teaches the use of a converging supersonic diffuser section followed by a diverging subsonic diffuser section. A shock wave is thus avoided. However, this arrangement is limited to a design operating speed where the MACH 1 transition occurs between the two diffuser sections. Furthermore, flow enters the subsonic diffuser section at a velocity of MACH 1. This high velocity creates large viscous and turbulent losses within the boundary layer and limits the efficiency of the diffuser. Effective pressure recovery diffusion is limited to an area ratio of about 5:1 and the high speed gases still possess a considerable amount of kinetic energy at the point where the 5:1 area ratio is exceeded. This energy cannot be recovered without an additional diffusion stage.

SUMMARY OF THE INVENTION

A supersonic shock wave compressor diffuser in accordance with the invention includes an annular diffuser having a plurality of uniform circular diffusion channels defined therein. The diffusion channels are equally spaced about an impeller outer circumference within which a supersonic radial flow compressor rotor rotates about an axis of rotation. The diffusion channels each intersect with adjacent diffusion channels at inlet ends near the outer circumference of the compressor rotor and extend generally radially outward along central, longitudinal curved axes to outlet ends which are spaced radially outward from the inlet ends relative to the axis of rotation. The diffusion channels have circular cross sections in planes perpendicular to the longitudinal axes, with the diameter, and thus the area of the channel cross sections, increasing at an increasing rate as the distance from the inlet end of the channel along the length of the central axes increases.

Unlike other channel diffusers which attempt to avoid a compression shock wave, the channel inlets of the present arrangement are disposed in close proximity to the outer circumference of the supersonic centrifugal compressor rotor to insure that gas flow is supersonic as it approaches the inlets to the diffusion channels. Across the shock wave there is a substantial increase in pressure and a decrease in velocity in approximate accordance with the relationship $M_iM_o = 1$, where $M_i$ is the velocity MACH number on the inlet side of the shock plane and $M_o$ is the velocity MACH number on the outlet side of the shock plane. Because the shock wave provides a substantial static pressure recovery within a very short distance, the overall length of the diffusion channels can be substantially reduced and boundary layer losses are reduced accordingly. Even greater reductions in boundary layer losses result from the initiation of subsonic diffusion at velocities substantially below MACH 1. Since the greatest losses occur at regions of highest velocity within a subsonic diffuser, the increase in subsonic diffusion efficiency is quite substantial. Furthermore, effective pressure recovery subsonic diffusion is limited to an area ratio of approximately 5:1 and since subsonic diffusion begins at lower velocities, the gas velocities after diffusion through an area ratio of 5:1 is also less and the nonrecoverable kinetic energy of the gases is greatly reduced.

To further maximize pressure efficiency and pressure recovery ratios, diffusion channels in accordance with the invention are circular in cross section perpendicular to central longitudinal axes and the longitudinal axes follow a path defined by a logarithmic spiral which intersects the outer circumference of the compressor rotor at an angle at which gases are discharged therefrom at the most common operating velocities. The logarithmic spiral path of the longitudinal axes, which may be approximated by a circular arc, permits recovery of the angular momentum which results from the tangential velocity component of gases leaving the compressor rotor. The circular cross-sectional shape of the diffusion channels permits recovery of swirl velocity energy of gas flow through the diffusion channels.

BRIEF DESCRIPTION OF THE DRAWINGS

A better understanding of the invention may be had from a consideration of the following detailed description taken in conjunction with the accompanying drawings, in which.

DETAILED DESCRIPTION

Figure 1:
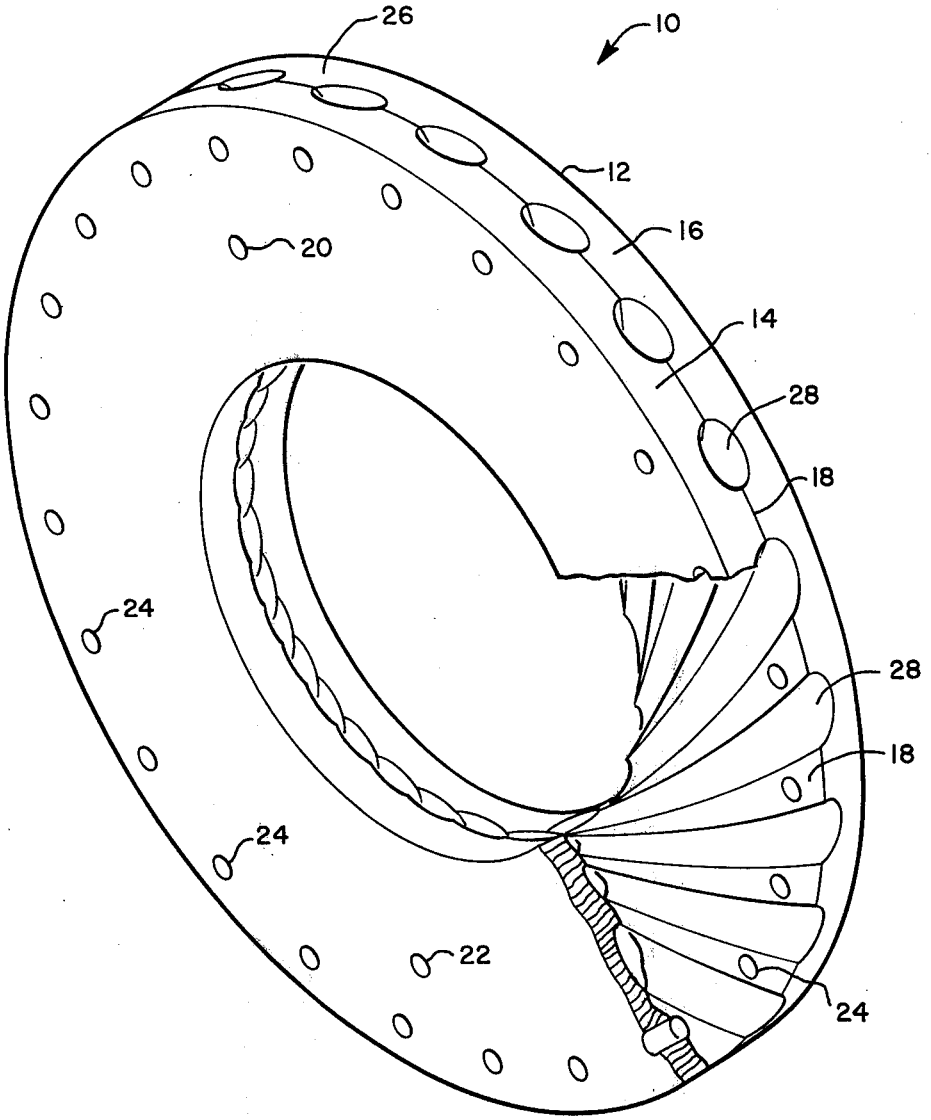
FIG. 1 is a perspective view, partly broken away of an annular, shock wave diffuser for a supersonic, centrifugal compressor in accordance with the invention.

As shown in FIG. 1, a supersonic shock wave compressor diffuser 10 in accordance with the invention for use with a supersonic radial flow compressor has an annular diffuser body formed by first and second mating halves 14, 16, respectively, which meet along a central, radially extending plane 18. Within the diffuser body 12 are two axially extending alignment holes 20, 22 which receive alignment pins with a force fit to insure that perfect alignment is attained between the first and second mating halves 14, 16, respectively. A plurality of axially extending bolt holes 24 are located about the diffuser body 12 adjacent an outer circumference 26 and are circumferentially positioned so as to pass between adjacent pairs of diffusion channels 28. The bolt holes 24 serve to maintain the first and second halves 14, 16 in mating relationship and to secure the diffuser body 12 to a housing or other support structure for maintaining the diffuser 10 in fixed concentric relationship about the periphery of a compressor rotor.

Figure 2:
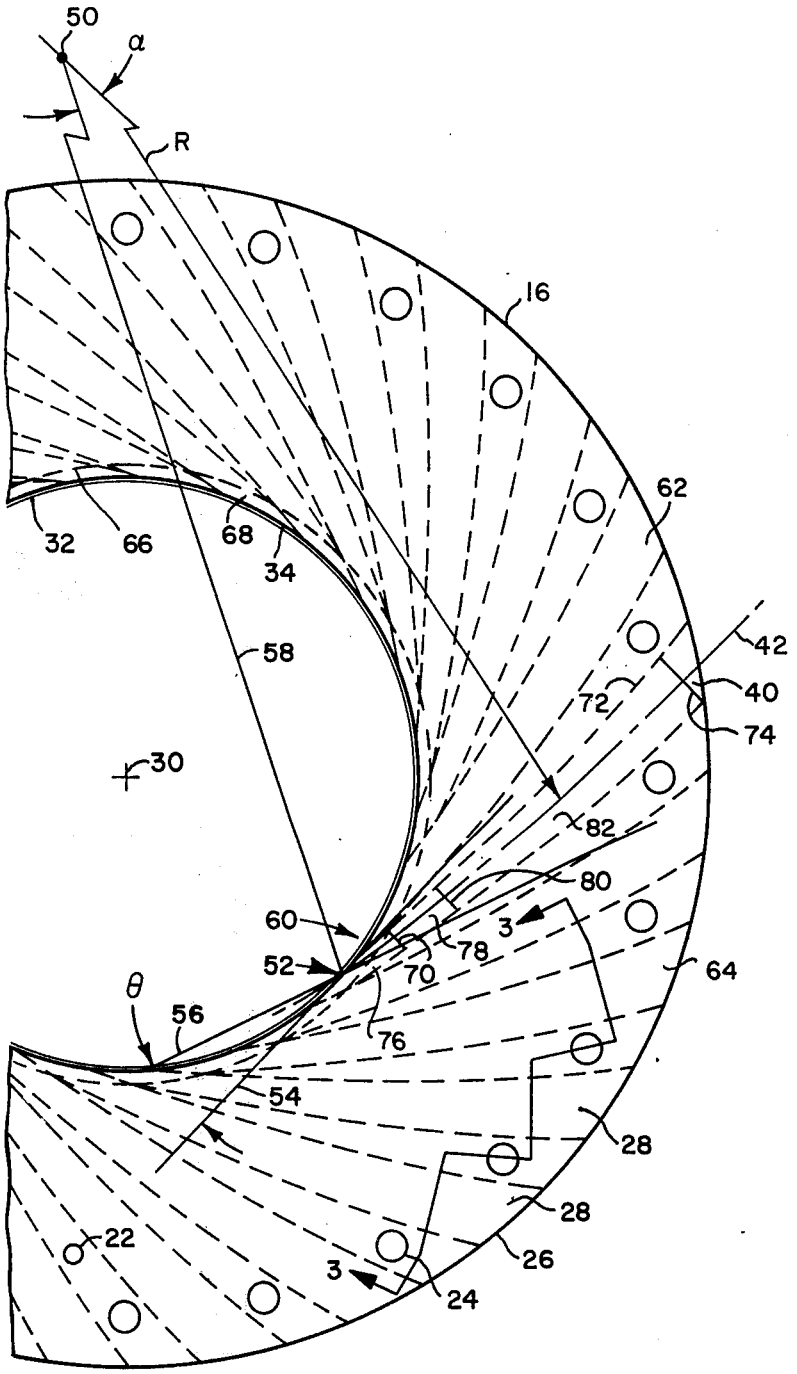
FIG. 2 is a fragmentary plan view of a portion of one mating half of the diffuser; and, FIG. 3 is a fragmentary, sectioned view of both halves of the diffuser shown in FIG. 1, taken along the path indicated by broken line 3—3 as shown in FIG. 2.
Figure 3:
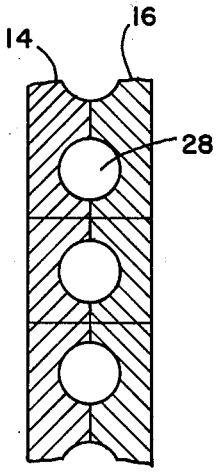

Making further reference to FIGS. 2 and 3, an outer circumference within which a radial flow supersonic compressor rotates about an axis of rotation 30, which is perpendicular to the plane of FIG. 2, is indicated by a circle 32. Although the invention is not limited thereto, in the particular embodiment shown, the compressor rotor and diffuser 10 form the compressor stage for a single shaft gas turbine engine for industrial and agricultural vehicle applications. Because of space limitations, it is extremely important to keep the overall size of the engine as small as possible. In this particular application the outer periphery circle 32 has a diameter of 6 inches, an inner circumference 34 of the diffuser body 12 has a diameter of 6.026 inches, and the outer circumference 26 of diffuser body 12 has a diameter of 12 inches. The diameter of the inner circumference 34 is desirably maintained as small as possible consistent with maintaining adequate clearance between the circumference of rotation 32 and the inner circumference 34 to prevent damage to the compressor rotor. While as few as 16 channels may be adequate, the diffuser preferably has at least 20 diffusion channels 28 and has 24 such channels in the particular embodiment disclosed herein.

As particularly represented by diffusion channel 40, each of the diffusion channels 28 has a circular cross section in planes which are perpendicular to a longitudinally extending central axis 42 lying in the plane 18. The longitudinal axis 42 preferably follows a logarithmic spiral path which permits the conservation of angular momentum of gases which are emitted from the compressor rotor with a tangential velocity component. However, for ease of manufacturing, the logarithmic spiral path of the longitudinal axis 42 may be approximated by a circular arc having a center point 50 and a radius R which is 15 inches in length in the present application. The center point 50 is desirably located by choosing a reference point 52 at the intersection of the longitudinal axis 42 with the inner circumference 34. A tangent line 54 to the inner circumference 34 is established at the point 52 and a tangent line 56 to the longitudinal axis 42 is established at the point 52. An angle $\theta$ at which tangent line 56 intersects tangent line 54 is established to approximate the angle at which gases leave the compressor rotor at the most common operating speed. The center point 50 is then located along a radius 58 which passes through the point 52 perpendicular to tangent line 56. Henceforth the perpendicular radius 58 will serve as a zero reference point for angular displacements $\alpha$ relative thereto. Angle $\theta$ equals 15° in the present particular example.

At an inlet end 60 the channel 40 intersects with adjacent diffusion channels 62, 64 on opposite sides thereof. If the divergence angle of the diffusion channels is small at the inlet end 60, the locus of intersection of adjacent channels lies approximately on a plane which is parallel to the axis of rotation 30 and forms an elliptical arc. The extremity of the major axis of the elliptical arc for each locus of intersection lies on a circle 66 which defines the greatest circumference of a semi-vaneless diffusion space 68 between the inlet 60 to the diffusion channels and the circumferential circle of rotation 32 of the compressor rotor. As used herein, the inlet of the diffusion channels 28, as illustrated by channel 40, is deemed to lie in a plane 70 which is perpendicular to the longitudinal axis 42 and intersects the circle 66 in the plane 18 at a radially inward side 72 of the channel 40. The diameter of the channels 28 at the inlet ends thereof is preferably maintained sufficiently small with regard to the number of diffusion channels 28 and the circumference of rotation 32 that the semi-vaneless diffusion space 68 is kept quite small. This insures that the supersonic gas flow is not appreciably decelerated within the semi-vaneless diffusion space 68 and that it approaches the inlets of the diffusion channels 28 at as high a velocity as possible. Efficiency, however, requires that some semi-vaneless diffusion space 68 occur in order to present a sharp edge between adjacent diffusion channels to gases which are emitted from the compressor rotor. Best efficiency is attained when the shock waves occur adjacent the inlet of the channels. In the present, preferred example, the diameter of the circle 66 which defines the maximum circumference of the semi-vaneless diffusion space 68 has a diameter of approximately 1.047 times the diameter of the circle 32 which defines the outer circumference of rotation of the compressor rotor. This corresponds to a diameter of about 1.042 times the diameter of the inner circumference 34 of diffuser body 12. In any event, the diameter of the circle 66 is desirably less than 1.06 times the diameter of the outer circumference 32 of the compressor rotor. This corresponds to approximately 1.055 times the diameter of the inner circumference 34.

As the distance along the longitudinal axis 42 from the inlet plane 70 increases in a radially outward direction from rotation axis 30, the cross-sectional area of the channel 40 increases at an increasing rate. As is well known, if the divergence angle of the channel 40 is too great and the area increases too rapidly with respect to arcuate length L along the length of the longitudinal axis 42, flow separation occurs in the boundary layer adjacent the channel walls and substantial losses occur with the kinetic energy of the gas being converted to heat instead of to static pressure. On the other hand, if the divergence angle is too small and the cross-sectional area increases at too slow a rate with respect to the arcuate length L of the longitudinal axis 42, the channel 40 is unnecessarily long and the frictional losses between the walls of channel 40 and the gases is greater than necessary.

In the present example advantage is taken of the characteristic of gases which permits the divergence angle to be increased without flow separation occurring as the gas velocity decreases by increasing the channel diameter perpendicular to the longitudinal axis 42 at an increasing rate as the distance from the inlet plane 70 increases. In the present example the diameter at the inlet is 0.282 inches while the diameter along an outlet plane 74 is 0.6304 inches. The outlet plane 74 is disposed at approximately an angle $\alpha = 17.0703°$ relative to the zero reference radius 58 while the inlet plane 70 is displaced at an angle $\alpha = 3.1320°$ relative to the reference radius 58. The arcuate length of longitudinal axis 42 between the outlet plane 74 and inlet plane 70 is thus approximately $(17.0703° - 3.1320°) \times (15$ inches/57.296 deg/rad) = 3.649 inches. The cross-sectional area of the channel 49 at the outlet plane 74 is approximately 5 times the cross-sectional area of the channel 40 at the inlet plane 70. This corresponds to the maximum area ratio over which effective pressure recovery diffusion can take place. Beginning with the inlet plane 70, the second derivative of the channel diameter $D$ with respect to arcuate length $L$ of longitudinal axis 42, $d^2D/dL^2$ is preferably a constant, $K_1 =$ 0.0526 inches per inch$^2$. Assuming a zero divergence angle at the inlet plane 70, the derivative of the channel diameter D with respect to arcuate length $L$, $(dD/dL) = K_1L$ and the diameter is $D = \frac{1}{2} K_1L^2 + 0.282$. Radially inward of the inlet plane 70, the channels are cylindrical with no divergence.

It has been found that for ease of manufacturing, the preferred channel divergence may be effectively approximated by milling the diffusion channel 40 in three separate conical segments and then smoothly blending the sharp transitions which occur at the intersection of walls of adjacent conical segments into each other. In one preferred embodiment a first conical segment 76 occurs at all positions along the channel 40 which are radially inward of the inlet plane 70 which is disposed at the radial position $\alpha = 3.132°$. The first conical segment 76 is actually the special case of a cylinder with no divergence and a constant diameter of 0.282 inches. A second conical segment 78 lies between the inlet plane 70 and a reference plane 80 which lies at an angle $\alpha = 5.6112°$ from the zero reference radius 58 and forms the beginning of the subsonic diffusion region during preferred operating conditions when the shock waves occur adjacent the inlet plane 70. The second conical segment 78 has an effective included divergence angle of 3° and a diameter of 0.316 inches at the reference plane 80 prior to blending. The third conical segment 82 occupies all portions of the channel 40 which are radially outward from the reference plane 80. The third conical segment 82 has an effective included divergence angle of 6°.

During the course of operation, gases leave the circumference of rotation 32 of the compressor rotor at supersonic velocities which are decreased only slightly at the gases pass through the semi-vaneless diffusion space 68. A primary compression shock wave occurs very near the inlet plane 70 either within the semi-vaneless diffusion space 68 on a radially inward side of plane 70 or within the channel 40 on a radially outward side of plane 70. The exact position of the shock wave varies with compressor operating conditions and especially static pressure at the outlet. As outlet static pressure decreases the shock wave tends to move radially outward to the inlet of the diffusion channels 28. If static pressure becomes too low, a secondary shock wave is formed, and efficiency decreases substantially. The secondary shock wave moves radially outward through the second conical segment 78 as outlet static pressure continues to decrease. Under preferred operating conditions the secondary shock wave is avoided and the primary shock wave occurs very near the inlet plane 70. The gases on the inlet side of the compression shock plane preferably have a velocity MACH number of about 1.5 and, for the particular configuration of compressor rotor and diffuser 10 disclosed herein, have been found to have a MACH number of approximately 1.35. As the velocity MACH number on the inlet side increases beyond approximately 1.7, a substantial decrease in the efficiency of the shock wave is experienced.

Under preferred conditions subsonic diffusion takes place within the second conical segment 78 and within the third conical segment 82. Because the gas velocity on the outlet side of the primary shock wave is substantially below MACH 1, the boundary layer viscous losses associated with subsonic channel flow at velocities close to MACH 1 are avoided and the unrecoverable kinetic energy of the gases after a maximum pressure recovery diffusion area ratio of 5:1 is substantially reduced. In the event that a secondary shock wave occurs within second conical segment 78, subsonic diffusion occurs downstream therefrom. The required length of the diffusion channels 28 is greatly reduced by the substantial velocity reduction and pressure increase which occurs across the extremely short compression shock wave and the diameter of the outer circumference 26 of the annular diffuser body 12 is reduced by the use of the small angle $\theta$ and the circular arc curvatures of the diffuser channels. These conditions combine to permit a diffusion channel having an effective arcuate length along the longitudinal axis of $L = 3.649$ inches to be located within a radial distance of 2.718 inches along the center line of the channel with respect to the axis of rotation 30. The diffuser body 12 may thus be smaller and more compact in order to decrease the size of a gas turbine engine within which it is used.

While there has been shown and described above a particular arrangement of an annular channel diffuser for a supersonic centrifugal compressor for the purpose of enabling a person of ordinary skill in the art to make and use the invention, it will be appreciated that the invention is not limited thereto. Accordingly, any modifications, variations or equivalent arrangements within the scope of the attached claims should be considered to be within the scope of the invention.

What is claimed is:

1. A diffuser for use with a centrifugal compressor comprising first and second body halves mating along a central plane to define an annular diffuser body having a central axis, an inner circumference adapted for concentric disposition about the periphery of a centrifugal compressor in close proximity thereto, and an outer circumference, said diffuser body having a plurality of curved diffusion channels defined therein which extend between the inner and outer circumference and which curve toward a direction of a tangential velocity component of gases entering the diffuser channels at the inner circumference, the diffusion channels having a cross section perpendicular to a central longitudinal axis therealong which is at least generally circular and a divergence angle which increases with distance from the inner circumference without sharp transitions in the diffusion channel walls to provide each channel with a diameter that increases at an increasing rate as distance from the inner circumference increases, adjacent diffusion channels intersecting near the inner circumference along a sharp, generally elliptical edge which is in close proximity to the outer circumference of a centrifugal compressor.

2. The diffuser according to claim 1 above, wherein the maximum diameter of the vaneless diffusion space between the outer circumference of a compressor and inlets to the diffusion channels is not more than 1.05 times the diameter of the inner circumference of the diffuser.

3. The diffuser according to claim 1 above, wherein the maximum diameter of the vaneless diffusion space between the outer circumference of a compressor rotor and inlets to the diffuser channels is not more than 1.06 times the diameter of the outer circumference of the compressor rotor.

4. The diffuser according to claim 1 above, wherein the diffuser is for use with a centrifugal compressor rotor from which compressed gases exit an outer periphery of the compressor rotor at supersonic velocities at normal operating speeds, and wherein inlets to the diffusion channels are located sufficiently close to the periphery of the compressor rotor that shock waves occur adjacent inlets to the channels under normal operating conditions.

5. The diffuser according to claim 1 wherein each diffusion channel has a longitudinal central axis extending therealong and is circular in cross section normal to the longitudinal axis.

6. The diffuser according to claim 5 above, wherein the diffuser is for use with a compressor rotor having an outer circumference which is 6 inches in diameter, wherein the diffuser has an outer circumference which is not more than 12 inches in diameter, and wherein there are between 20 and 24 diffusion channels within the diffuser.

7. The diffuser according to claim 6 above, wherein there are 24 channels and wherein each diffusion channel has a diameter of approximately 0.28 inch at the inlet thereof and a diameter of approximately 0.63 inch at a radially outwardmost point along the longitudinal axis thereof at which a cross section perpendicular to the longitudinal axis lies entirely within a circle about the axis of rotation having a radius of 12 inches.

8. The diffuser according to claim 6 above, wherein the longitudinal axis of each channel approximates a logarithmic spiral path by following a circular arc.

9. The diffuser according to claim 8 above, wherein the circular arc has a radius of 15 inches and wherein the longitudinal axis of each diffusion channel intersects an inner circumference of the diffuser at a reference point and wherein for each diffusion channel a tangent to the longitudinal axis at the reference point intersects a tangent to the inner circumferences of the diffuser at the reference point with an included acute angle of 15°.

10. A compressor diffuser for use with a supersonic, centrifugal compressor rotor which rotates within an outer circumference about an axis of rotation, the diffuser comprising an annular diffuser body having a plurality of circular cross-section diffusion channels defined therein, each of said channels intersecting with adjacent channels at inlet ends which are concentrically disposed about the outer circumference of a compressor rotor in close proximity thereto to permit a fluid passing through the compressor to approach the inlet end of each channel at a supersonic velocity with as high a mach number as possible and form a shock wave thereat, each of said channels extending along a longitudinal axis from an inlet end to an outlet end which is spaced radially outward from the inlet end, each of said channels having a first region in which the diameter increases at a first rate with respect to length along the longitudinal axis and each of said channels having a second region radially outward from the first region in which the diameter increases at a second rate greater than the first rate with respect to length along the longitudinal axis with channel walls being free of sharp transitions between the first and second regions.

11. The compressor according to claim 10 above, wherein the diameters of each channel approximately follows the relationship $D = \frac{1}{2} K_1 L^2 + K_2$, where $D$ is the channel diameter, $L$ is channel length along the longitudinal axis from the inlet end, $K_1$ is a constant and $K_2$ is the channel diameter at the inlet end.

12. The compressor according to claim 11 above, wherein $K_1$ is approximately 0.053 inches per inch$^2$.

13. The compressor diffuser according to claim 12 above, wherein the longitudinal axis of each channel extends along a circular arc which intersects said outer circumference at an angle of approximately 15°.

14. The compressor diffuser according to claim 12 above, wherein the longitudinal axes of all of the diffusion channels lie within a single plane.

15. The compressor diffuser according to claim 10 above, wherein the diffusion channels have a circular cross section normal to their longitudinal axis and wherein for each channel between an inlet end and a point along the longitudinal axis where the cross-sectional area is 5 times the cross-sectional area at the inlet end, the second derivative of the channel diameter with respect to arcuate longitudinal axis length is substantially constant.

16. The compressor diffuser according to claim 15 above, wherein said second derivative is approximately 0.014 inches per inch$^2$.

17. The compressor diffuser according to claim 10 above, wherein the inlet of each channel is disposed sufficiently close to the periphery of the compressor that a shock wave occurs near the inlet and wherein gas velocity in the radially inward side of the shock wave is at least MACH 1.35.

18. A diffuser for receiving gases discharged from a circumference of a centrifugal compressor and increasing the static pressure thereof, the diffuser comprising an annulus extending about a central axis and having an inner circumference which fits closely about the periphery of a compressor wheel, an outer circumference radially spaced from the inner circumference, a pair of spaced opposing sides extending between the inner and outer circumferences, and a plurality of channels which are curvilinear in cross section extending between the inner and outer circumferences intermediate the opposing sides each channel having a smallest cross-sectional area adjacent the inner circumference and expanding substantially continuously and with an increasing divergence angle with increasing radial position relative to the central axis to a largest cross-sectional area at the outer circumference with smoothly blended transitions between changes in divergence, adjacent channels intersecting near the inner circumference along sharp edges which are disposed close to the circumference of the centrifugal compressor to induce a shock wave at an inlet to each channel near the sharp edges with a maximum mach number on the radially inward side of the shock wave.

19. The diffuser as set forth in claim 18 above, wherein the longitudinal central axis of each channel extends radially outward in circular arc having a radius greater than the radius of the outer circumference of the diffuser.

20. A compressor diffuser for use with a supersonic, centrifugal compressor rotor which rotates within an outer circumference about an axis of rotation, the diffuser comprising a diffuser body having a plurality of diffusion channels defined therein with walls which have any transitions in shape along the length thereof smoothly blended, each of said channels intersecting with adjacent channels at inlet ends which are concentrically disposed about the outer circumference of the compressor rotor in close proximity thereto with a small semi-vaneless diffusion space being defined between the outer circumference and the inlet ends, said diffuser having a primary shock wave formed in the semi-vaneless diffusion space adjacent the inlet ends under normal operating conditions.

21. The compressor diffuser according to claim 20 above, wherein gas flow has a velocity of at least MACH 1.35 on a radially inward side of the primary shock wave.

* * * * *

UNITED STATES PATENT AND TRADEMARK OFFICE

CERTIFICATE OF CORRECTION

PATENT NO. : 4,012,166

DATED : March 15, 1977

INVENTOR(S) : Merle L. Kaesser and Homer J. Wood

It is certified that error appears in the above-identified patent and that said Letters Patent are hereby corrected as shown below:

Column 5, line 34, "49" should read --40--.
Column 6, line 8, "at" should read --as--.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*